US007537016B1

(12) United States Patent
You

(10) Patent No.: US 7,537,016 B1
(45) Date of Patent: May 26, 2009

(54) GOLF BAG UMBRELLA WITH A FLEXIBLE JOINT THREADEDLY SECURED TO AN INTERMEDIATE PORTION OF A TELESCOPIC CENTER POST

(76) Inventor: Ching-Chuan You, 4Fl. No. 27, Lane 160, Hsin Sheng S. Rd., Sec. 1, P.O. Box 1-79, Taipei (TW) 100

( * ) Notice: Subject to any disclaimer, the term of this patent is extended or adjusted under 35 U.S.C. 154(b) by 0 days.

(21) Appl. No.: 12/007,062

(22) Filed: Jan. 7, 2008

(51) Int. Cl.
*A45B 3/00* (2006.01)
*A63B 55/00* (2006.01)

(52) U.S. Cl. ..... 135/16; 135/20.1; 135/25.4; 248/160; 248/514; 206/315.4; 403/229

(58) Field of Classification Search ..... 135/15.1, 135/16, 25.4, 20.1, 125; 248/160, 145, 514, 248/548; 206/315.4; 116/173; 40/220, 229; 403/220, 229, 291
See application file for complete search history.

(56) References Cited

U.S. PATENT DOCUMENTS 2,554,708 A * 5/1951 Kosten ..... 440/102
2,559,934 A * 7/1951 Briney ..... 43/18.1 R
4,332,399 A * 6/1982 Kepple ..... 280/819
4,871,141 A * 10/1989 Chen ..... 248/534
5,297,570 A 3/1994 Conner
5,896,880 A * 4/1999 Bushweller et al. ..... 135/16
6,263,891 B1 * 7/2001 Hartwell et al. ..... 135/33.2
6,328,047 B1 * 12/2001 Lee ..... 135/20.1
6,471,289 B2 * 10/2002 Aguilar ..... 297/184.16
6,626,199 B2 * 9/2003 Lin et al. ..... 135/28
6,810,890 B2 11/2004 Lin et al.
6,899,388 B1 * 5/2005 Enrique ..... 297/184.16
7,069,938 B2 * 7/2006 Yen et al. ..... 135/16
7,185,665 B2 * 3/2007 You ..... 135/16

* cited by examiner

*Primary Examiner*—Winnie Yip

(57) ABSTRACT

A golf bag umbrella includes a threaded flexible joint of dumbbell shape in its telescopic center post, the joint being adapted to easily bend in a plurality of radially directed positions relative to the part of the center post therebelow in a safety manner for facilitating access to golf clubs disposed in a golf bag.

1 Claim, 9 Drawing Sheets

GOLF BAG UMBRELLA WITH A FLEXIBLE JOINT THREADEDLY SECURED TO AN INTERMEDIATE PORTION OF A TELESCOPIC CENTER POST

BACKGROUND OF THE INVENTION

1. Field of Invention

The invention relates to umbrella structures and more particularly to a golf bag umbrella having a threaded flexible joint in its telescopic center post so that the joint is adapted to bend in a plurality of radially directed positions relative to the part of the center post therebelow for facilitating access to golf clubs in a golf bag.

2. Description of Related Art

Golf bag umbrellas have been in existence for many years. For example, U.S. Pat. No. 5,297,570 discloses a golf bag umbrella which is characterized by providing a central spring connection for joining upper and lower extension tubes of handle shaft together, and a tilt umbrella canopy fixing device including a flexible cord having one end secured to a canopy periphery ring and the other end passing through an arresting plate and an anchor ring on the handle shaft to fix at the arresting plate so that the tilt umbrella canopy can be fixed at an oblique angle relative to the part of the handle shaft below the spring connection after bending the spring connection.

Disadvantages of the '570 patent are that an additional tilt umbrella canopy fixing device is required and an operation of restoring the tilted umbrella to its upright position by unfastening the tilt umbrella canopy fixing device may hurt the user accidentally if sufficient care is not taken since the restoring elastic force of the spring connection is great.

Also, U.S. Pat. No. 6,810,890 discloses an obstruction-free golf bag umbrella which is characterized by providing a bending portion in its handle shaft, the bending portion including an inner flexible rod, an outer reinforced restoring spring, and a restoring spring mounted therebetween.

Disadvantages of the '890 patent are detailed below. Three different resilient members are provided, resulting in a complex handle construction which in turn may involve a time consuming manufacturing process. Further, elastic deformations of the three constituent components of the bending portion are different when bending. Thus, a great force is required in its bending. Furthermore, an operation of restoring the tilted umbrella to its upright position may hurt the user accidentally since the restoring elastic force of the bending portion is great.

Thus, it is desirable to provide an improved golf bag umbrella in order to overcome the inadequacies of the prior art.

SUMMARY OF THE INVENTION

It is therefore one object of the invention to provide a golf bag umbrella having a threaded flexible joint in its telescopic center post, the joint being adapted to easily bend in a plurality of radially directed positions relative to the part of the center post therebelow without worrying about hurting a user for facilitating access to golf clubs disposed in a golf bag.

To achieve the above and other objects, the invention provides a golf bag umbrella comprising a telescopic center post having a distal end being provided with a covering foot, an upper extension, and a lower handle shaft tube affixed to the covering foot; a canopy stretched over hinged ribs radiating from a proximal end of the center post and which is moveable from a collapsed position around the center post to an extended position from the center post to provide a shade around the center post, wherein the upper extension includes an upper first extension tube, a first joining element affixed in the bottom of the first extension tube, the first joining element having a lower first threaded extension, a lower second extension tube slidably disposed in the handle shaft tube, a second joining element affixed in the top of the second extension tube, the second joining element having an upper second threaded extension, and a flexible joint including an upper threaded section threadedly secured onto the first threaded extension, a lower threaded section threadedly secured onto the second threaded extension, and a narrow intermediate section; and wherein the handle shaft tube includes a row of apertures directed therethrough, and the second extension tube includes a depressible spring detent mounted to a lower portion thereof, the spring detent being adapted to lockingly project out of one of the apertures.

The above and other objects, features and advantages of the invention will become apparent from the following detailed description taken with the accompanying drawings.

DETAILED DESCRIPTION OF THE INVENTION

Figure 1:
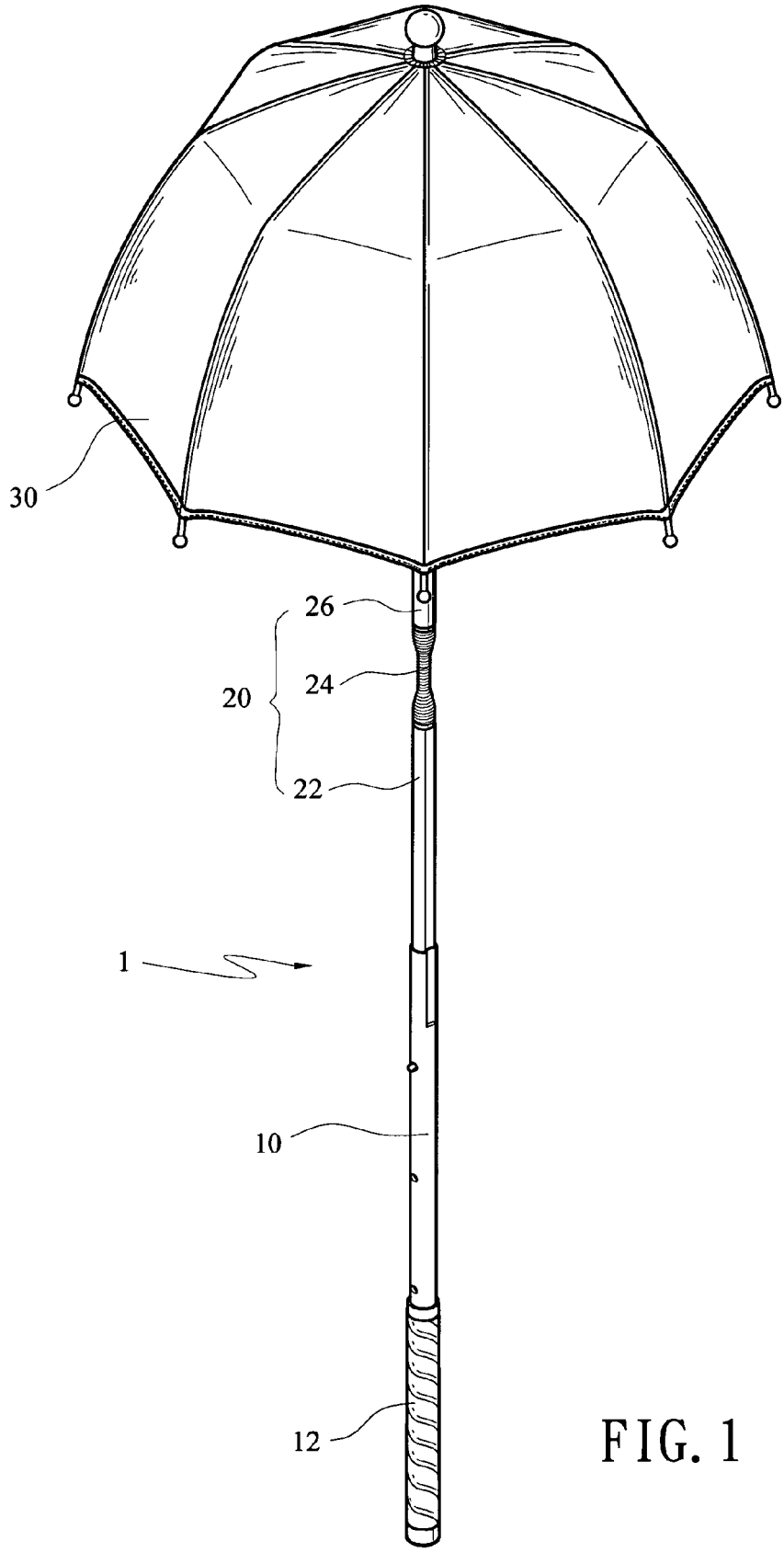
FIG. 1 is a perspective view of a preferred embodiment of golf bag umbrella according to the invention.
Figure 2:
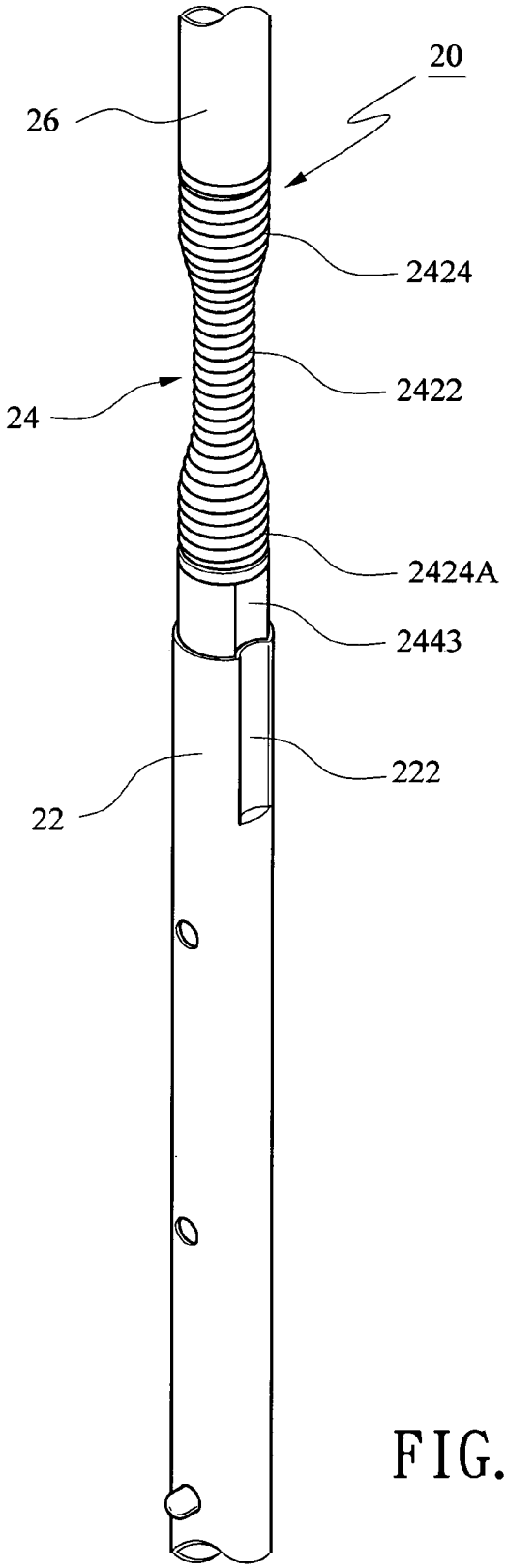
FIG. 2 is an enlarged view of the upper extension.
Figure 3:
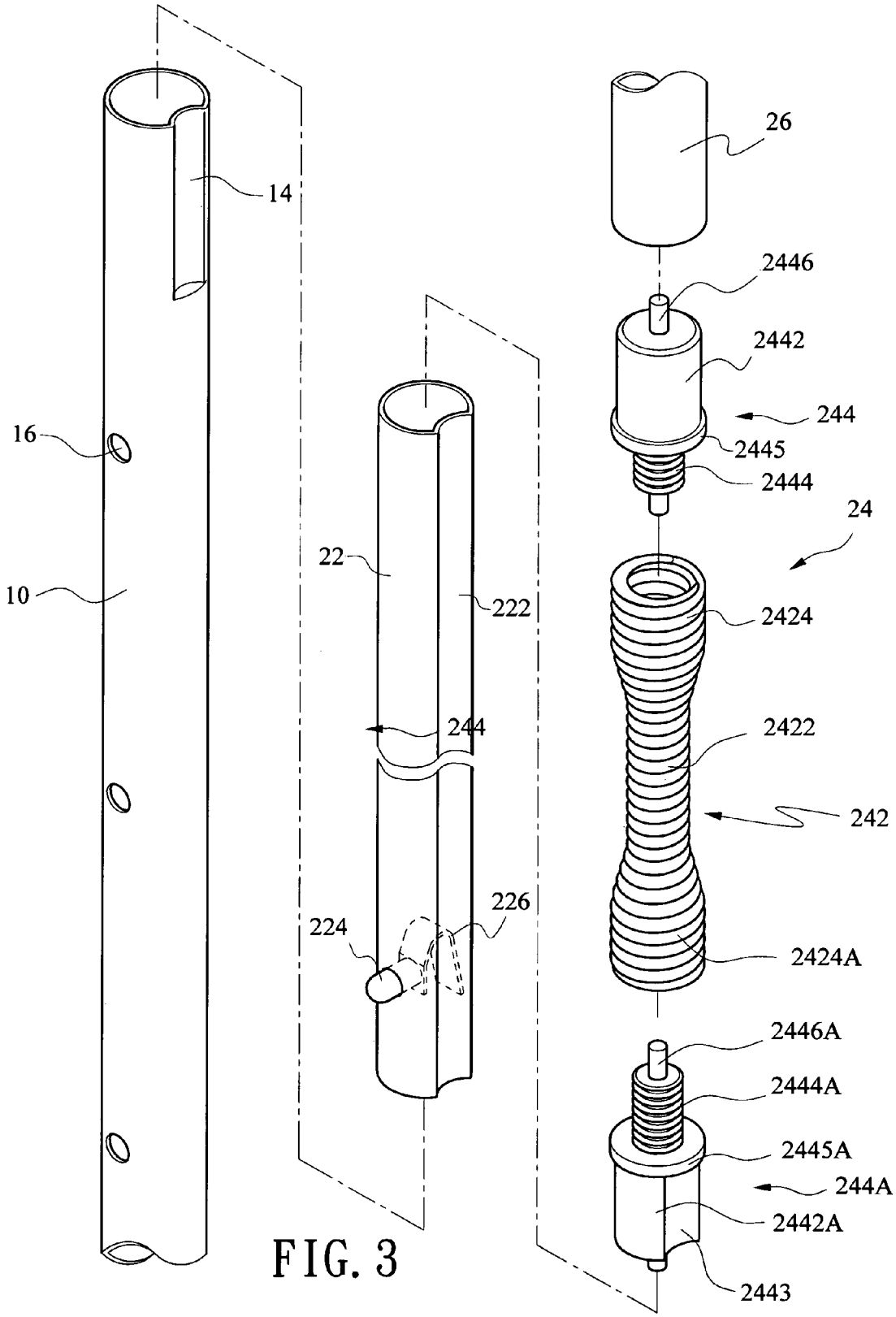
FIG. 3 is an exploded view of the upper extension of FIG. 2.
Figure 4:
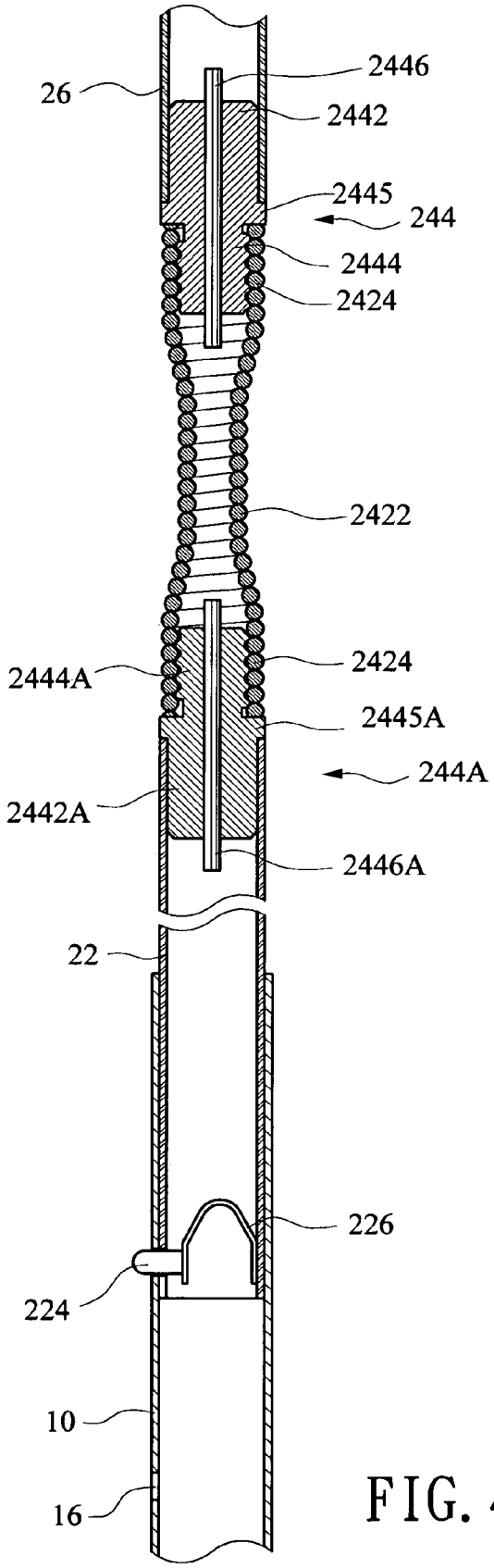
FIG. 4 is a longitudinal sectional view of the upper extension of FIG. 2.

Referring to FIGS. 1 to 4, a golf bag umbrella in accordance with a preferred embodiment of the invention is shown. The umbrella comprises a center post 1 including a handle shaft tube 10 and an upper extension 20 adapted to slide a lower portion thereof into the handle shaft tube 10, and a canopy 30 stretched over hinged ribs radiating from the top of the upper extension 20. The canopy 30 is moveable from a collapsed position around both the upper extension 20 and the handle shaft tube 10 to an extended position from both the upper extension 20 and the handle shaft tube 10 to provide a shade around both the upper extension 20 and the handle shaft tube 10. Each component is discussed in detail below.

The handle shaft tube 10 comprises a covering foot 12 at its lower portion, a row of equally spaced apertures 16 directed longitudinally on the handle shaft tube 10, and a longitudinal curved guide groove 14 on an upper portion of its outer surface. The upper extension 20 comprises an upper first extension tube 26, a lower second extension tube 22, and an intermediate flexible joint 24 interconnecting the first extension tube 26 and the second extension tube 22.

The first extension tub 26 has its top secured to a grommet (not numbered) on a center of the canopy 30. The second extension tube 22 comprises a longitudinal curved-guide groove 222 on the surface thereof, a gabled-shaped resilient member 226 mounted on the inner surface of the second extension tube 22 not axially aligned with the guide groove 222, and a plunger 224 having one end affixed to the resilient member 226 and the other end slidably passing through a surface aperture (not numbered) of the second extension tube 22, the other end of the plunger 224 being shaped as a half sphere. Thus, the plunger 224 may function as a depressible spring detent as detailed later.

The flexible joint 24 comprises an upper first joining element 244 formed of plastic including a cylindrical body 2442 having an outer diameter substantially the same as an inner diameter of the first extension tube 26 so as to snugly fit therein, a lower first threaded extension 2444 having a diameter smaller than that of the body 2442, an annular flange 2445 formed between the body 2442 and the first threaded extension 2444, and an axial reinforced bar 2446 through both the body 2442 and the first threaded extension 2444 and extending out of top and bottom ends of the first joining element 244; a lower second joining element 244A formed of plastic including a cylindrical body 2442A having a longitudinal curved guide groove 2443 on its surface, the body 2442A shaped to snugly fit in an upper portion of the second extension tube 22 with the guide grooves 2443, 222 being coaxially cooperatively engaged together (i.e., the body 2442A having an outer diameter substantially the same as an inner diameter of the second extension tube 22), an upper second threaded extension 2444A having a diameter smaller than that of the body 2442A, an annular flange 2445A formed between the body 2442A and the second threaded extension 2444A, and an axial reinforced bar 2446A through both the body 2442A and the second threaded extension 2444A and extending out of top and bottom ends of the second joining element 244A; and a flexible member 242 of spirally wound coil shaped including an upper threaded section 2424 adapted to threadedly secure onto the first threaded extension 2444, a lower threaded section 2424A adapted to threadedly secure onto the second threaded extension 2444A, and a flexible narrow intermediate section 2422, i.e., the flexible member 242 having a dumbbell shape.

The second extension tube 22 has an outer diameter substantially the same as an inner diameter of the handle shaft tube 10 so as to be adapted to snugly fit therein with the guide grooves 14, 2443 and 222 being coaxially cooperatively engaged together and the plunger 224 elastically projecting out of one of the apertures 16 for fastening the second extension tube 22 and the handle shaft tube 10 together.

Figure 5:
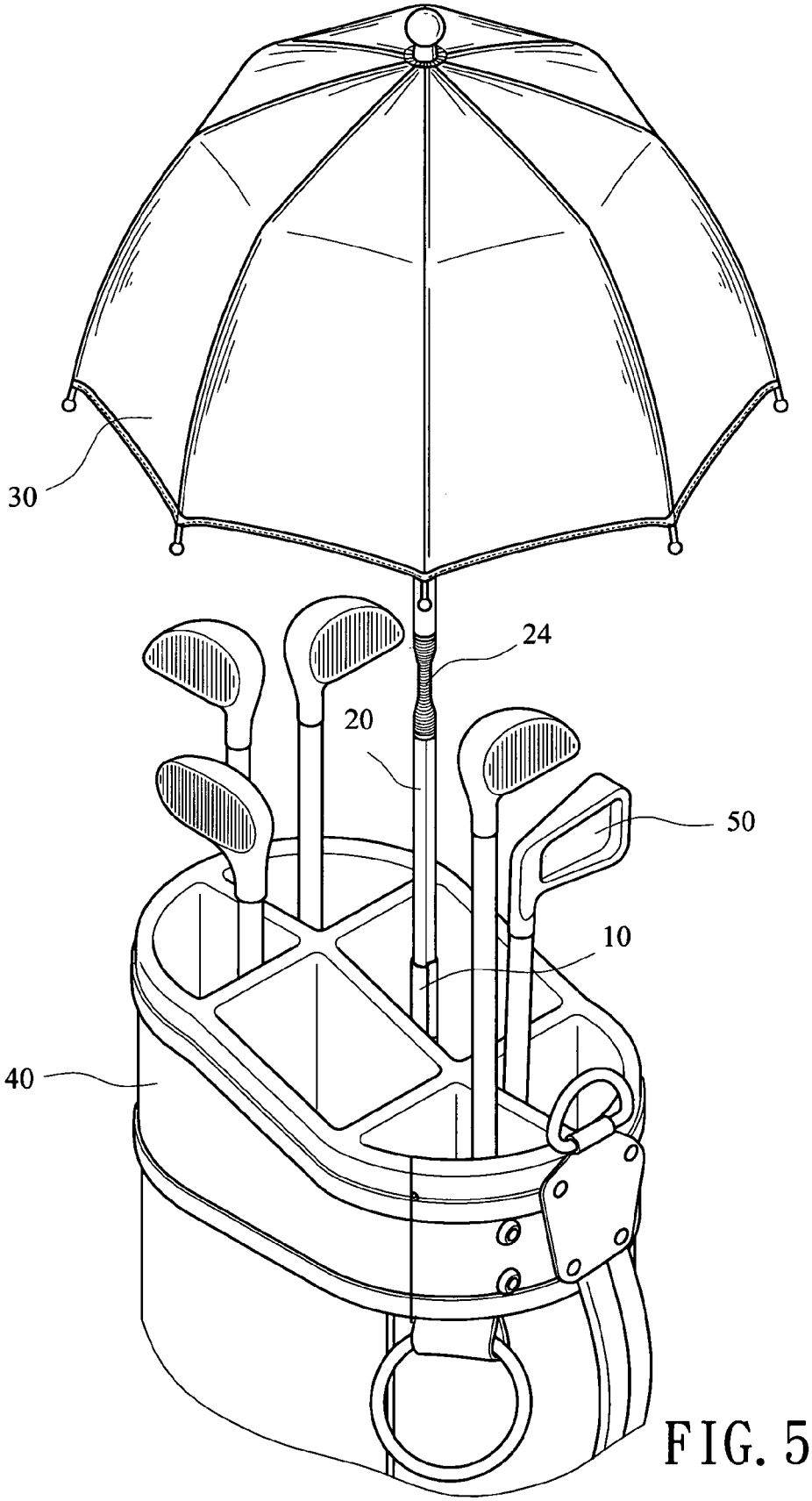
FIG. 5 is a perspective view of the golf bag umbrella anchored in a golf bag for providing a shade to golf clubs within the golf bag where the umbrella is in an upright position.
Figure 7:
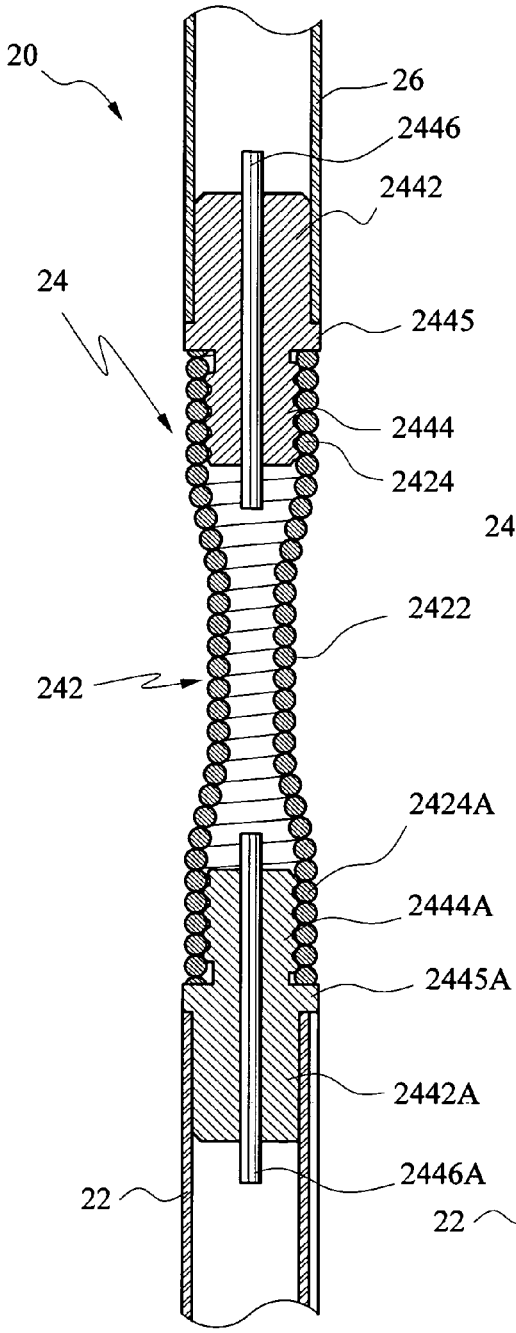
FIG. 7 is an enlarged view of an upper portion of FIG. 4 where the umbrella is in an upright position.

Referring to FIGS. 5 and 7, the umbrella 30 has its handle shaft tube 10 disposed in one of divider wall loops (not numbered) of a golf bag 40 with the covering foot 12 (not shown) fastened in the bottom of the golf bag 40. Also, a plurality of golf clubs 50 are disposed in the remaining divider wall loops. The umbrella 30 is open so as to protect the golf bag 40 and the golf clubs 50.

Figure 6:
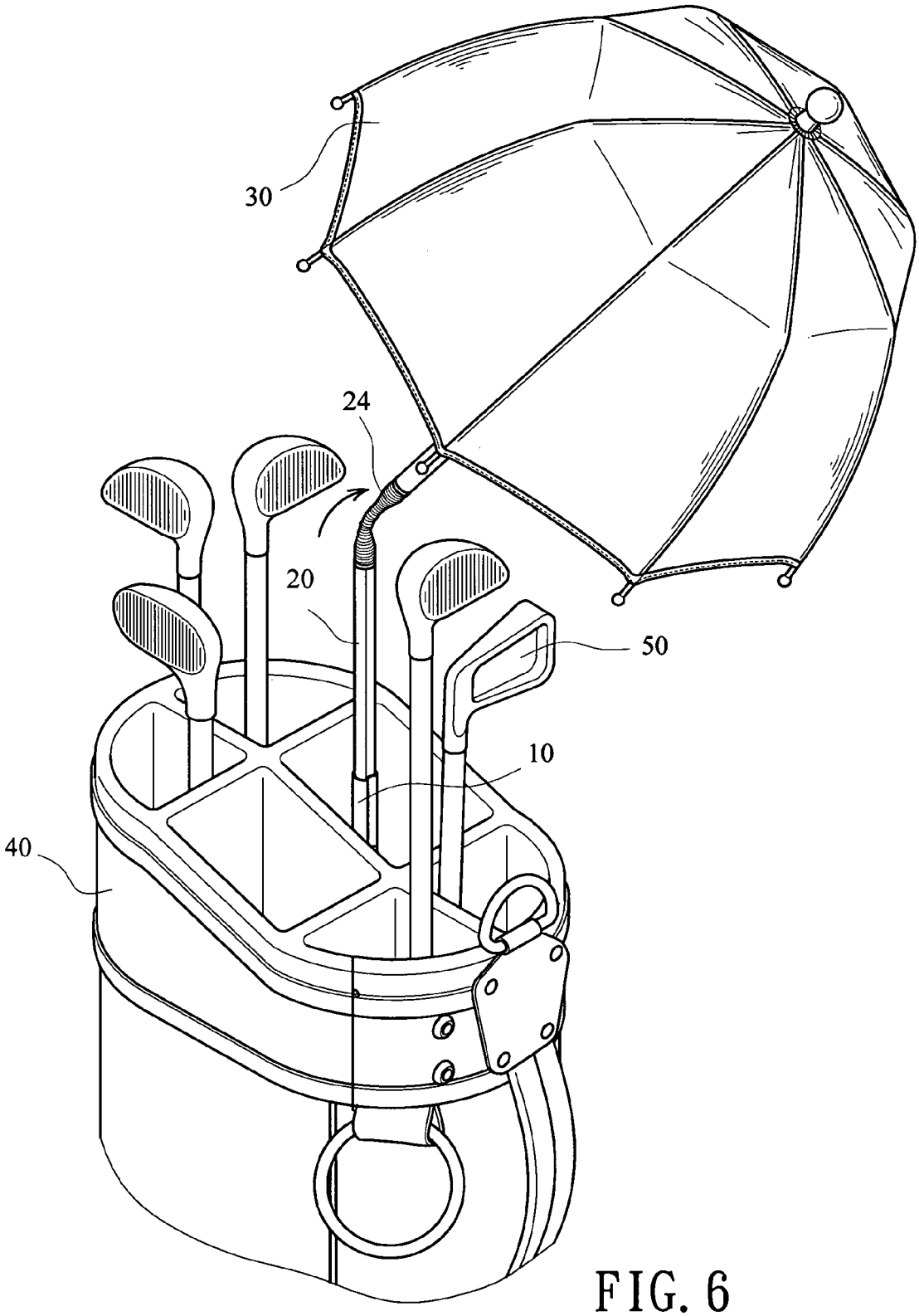
FIG. 6 is a view similar to FIG. 5 where the umbrella is in a tilt position for facilitating access to golf clubs disposed in a golf bag.
Figure 8:
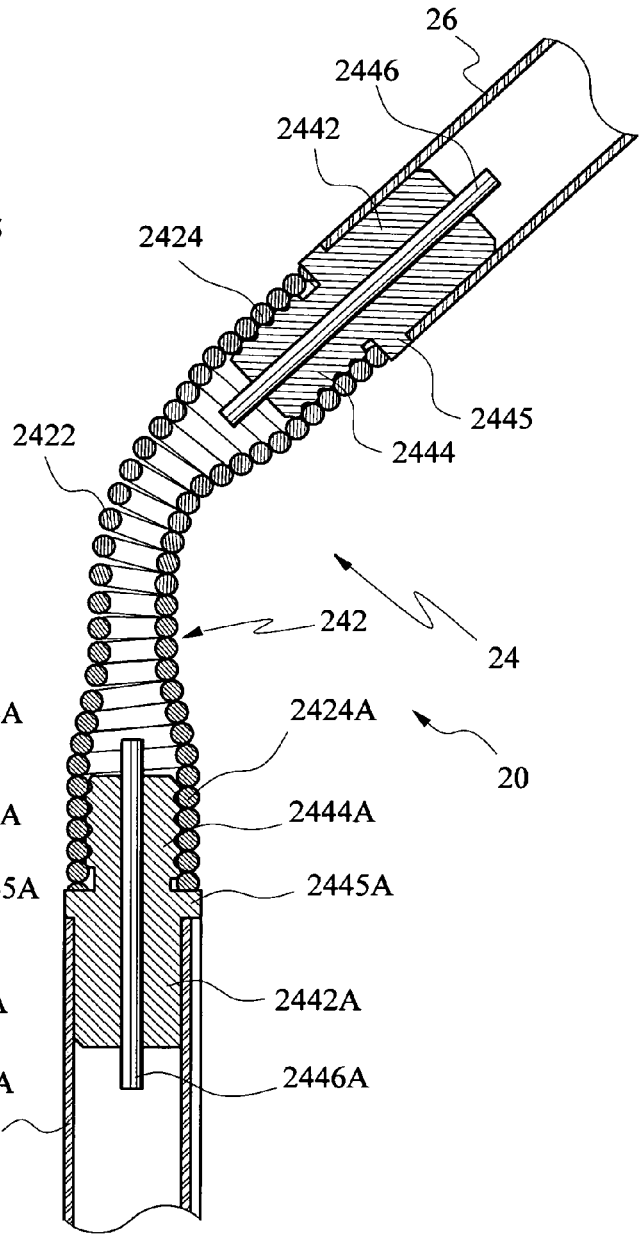
FIG. 8 is a view similar to FIG. 7 where the umbrella is in a tilt position for comparison therewith.

Referring to FIGS. 6 and 8, a person may bend the flexible member 242 to cause the first extension tube 26 and the second extension tube 22 to be angulate relative to each other so as to easily access the golf clubs 50.

Figure 9:
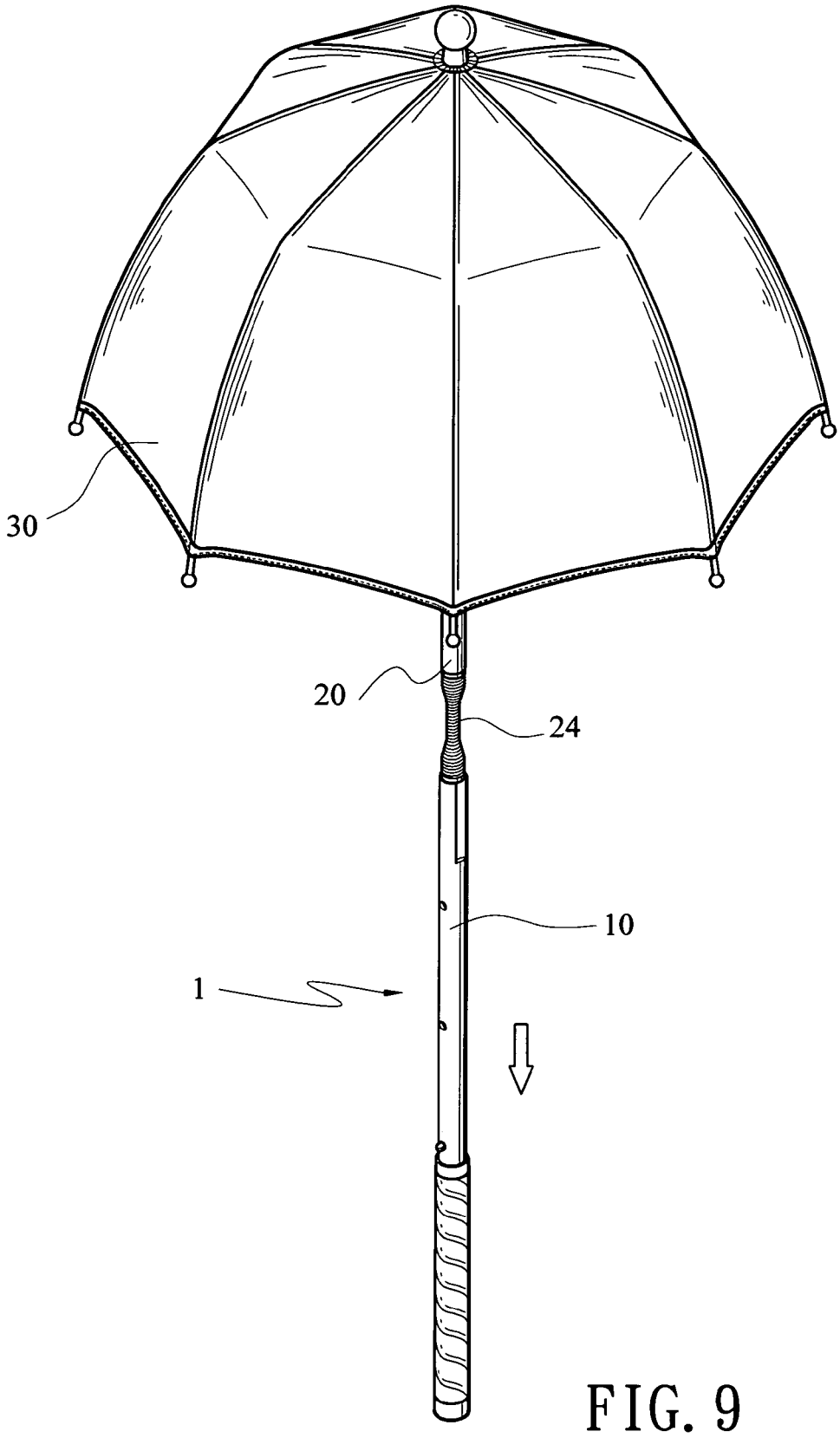
FIG. 9 is a view similar to FIG. 1 where the second extension tube has been completely retracted into the handle for decreasing height of the umbrella.
Figure 10:
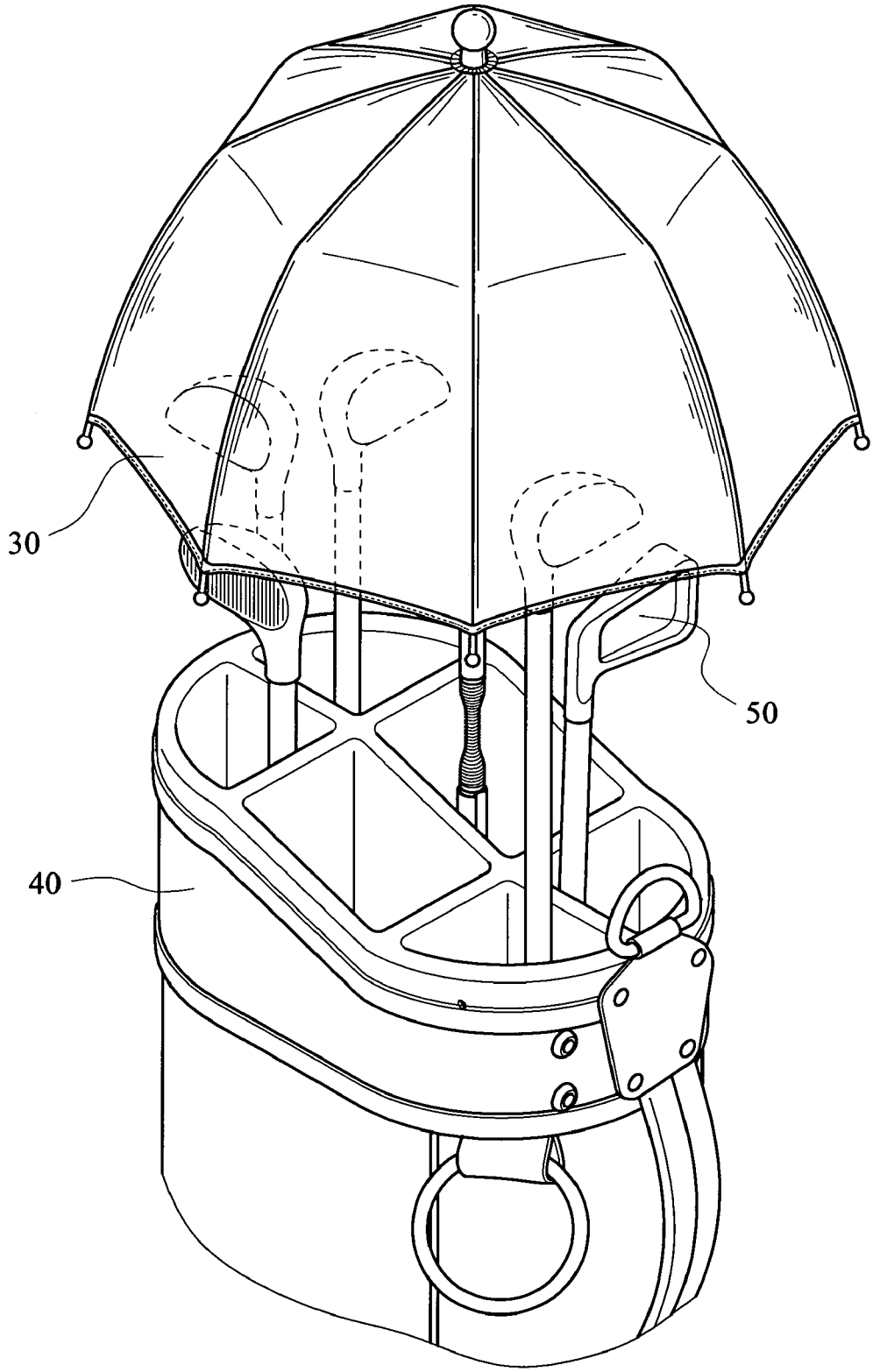
FIG. 10 is a view similar to FIG. 5 for showing the shade provided by the shortened umbrella of FIG. 9 to the golf clubs.

Referring to FIGS. 9 and 10, a person may perform the following actions to shorten the height of the umbrella 30. First, press the plunger 224 to clear the engaged aperture 16. Next, press the second extension tube 22 until the plunger 224 reaches a desired aperture 16. Finally, stop pressing the second extension tube 22 to cause the resilient member 226 to release its stored elastic force to push and project the plunger 224 out of the desired aperture 16. As a result, height of the umbrella 30 is shortened at this locked position.

The invention has the following advantages. The flexible joint 24 is structurally strong for permitting an extended times of bending operations. Thus, it is durable. As the diameter of the flexible narrow intermediate section 2422 is much smaller than that of the upper and the lower threaded section 2424 and 2424A of the flexible member 242, it means that during bending operation, the movement increment of the dumbbell-shaped flexible member 242 is much smaller than that of the conventional coil cylindrical-shaped spring, so the dumbbell shaped flexible joint 24 can reduce much of the required bending force. This means that the bending operation of the umbrella shank (i.e., a combination of the handle shaft tube 10 and the upper extension 20) at the flexible joint 24 is much labor saving. Therefore, it is safe. Its construction is also simple.

While the invention herein disclosed has been described by means of specific embodiments, numerous modifications and variations could be made thereto by those skilled in the art without departing from the scope and spirit of the invention set forth in the claims.

What is claimed is:

1. A golf bag umbrella comprising:

a telescopic center post (1) having a distal bottom end being provided with a covering foot (12), an upper extension (20), and a lower handle shaft tube (10) affixed to the covering foot and comprising a longitudinal curved first guide groove (14) on an upper portion; and a canopy (30) stretched over hinged ribs radiating from a proximal end of the center post (1) and which is moveable from a collapsed position around the center post (1) to an extended position from the center post (1) to provide a shade around the center post (1), wherein the upper extension (20) includes an upper first extension tube (26), a first joining element (244) affixed in the bottom of the first extension tube (26) and comprising a lower first threaded extension (2444) and an axial reinforced first bar (2446) having an upper end extending out of the top of the first joining element (244) and a bottom end extending out of the first threaded extension (2444), a lower second extension tube (22) slidably disposed in the handle shaft tube (10) and comprising a longitudinal curved second guide groove (222) on an outer surface, a second joining element (244A) affixed in the top of the second extension tube (22) and comprising an upper second threaded extension (2444A), an axial reinforced first bar (2446A) having a top end extending out of the second threaded extension (2444A) and a bottom end extending out of the bottom of the second joining element (244A), and a longitudinal curved third guide groove (2443) on an outer surface so that the first, the second, and the third guide grooves (14, 222, 2443) are adapted to axially cooperatively engage together, and a dumbbell shaped spirally wound coil spring (242) including an upper threaded section (2424) threadedly secured onto the first threaded extension (2444), a lower threaded section (2424A) threadedly secured onto the second threaded extension (2444A), and a narrow intermediate section (2422);

wherein the handle shaft tube (10) comprises a row of apertures (16) directed therethrough, and the second extension tube (22) includes a depressible spring detent (224) mounted to a lower portion thereof, the spring detent (224) being adapted to lockingly project out of one of the apertures (16); and wherein a diameter of the narrow intermediate section (2422) is smaller than that of the upper threaded section (2424) and the lower threaded section (2424A).

* * * * *